United States Patent [19]

Kalnin

[11] 4,056,874

[45] Nov. 8, 1977

[54] PROCESS FOR THE PRODUCTION OF CARBON FIBER REINFORCED MAGNESIUM COMPOSITE ARTICLES

[75] Inventor: Ilmar L. Kalnin, Millington, N.J.

[73] Assignee: Celanese Corporation, New York, N.Y.

[21] Appl. No.: 686,192

[22] Filed: May 13, 1976

[51] Int. Cl.[2] ..... B32B 15/14

[52] U.S. Cl. ..... 75/.5 R; 75/135; 75/168 R

[58] Field of Search ..... 75/135, 168 R; 29/191.2

[56] References Cited

U.S. PATENT DOCUMENTS

| | | | |
|---|---|---|---|
| 2,793,949 | 5/1957 | Imich | 75/135 |
| 3,384,463 | 5/1968 | Olstowski et al. | 75/168 R X |
| 3,600,163 | 8/1971 | Badia et al. | 75/135 |
| 3,728,108 | 4/1973 | Sifferlen et al. | 75/135 |
| 3,827,129 | 8/1974 | Denham et al. | 29/191.2 X |
| 3,840,350 | 10/1974 | Tucker | 29/191.2 |
| 3,888,661 | 6/1975 | Levitt et al. | 75/168 R X |
| 3,894,863 | 7/1975 | Lachman et al. | 75/168 R X |

*Primary Examiner*—L. Dewayne Rutledge
*Assistant Examiner*—E. L. Weise

[57] ABSTRACT

An improved process is provided for the formation of carbon fiber reinforced magnesium composite articles wherein substantially pure magnesium or magnesium alloys serve as the continuous matrix phase. A minor quantity of dispersed solid magnesium nitride sufficient to enhance the wettability of the carbon fiber reinforcement is provided in the molten magnesium containing metal when it is contacted with the carbon fiber reinforcement. The usual difficulties encountered when the production of such a composite article is attempted resulting from the inherent poor wettability of the carbon fibers by molten magnesium containing metal effectively are eliminated. The resulting composite article exhibits improved properties resulting from a more complete infiltration of the carbon fibers by the molten magnesium containing metal prior to solidification, and better adhesion between the fiber and metal.

12 Claims, No Drawings

PROCESS FOR THE PRODUCTION OF CARBON FIBER REINFORCED MAGNESIUM COMPOSITE ARTICLES

BACKGROUND OF THE INVENTION

In the search for high performance materials, considerable interest has been focused upon carbon fibers. The term "carbon fibers" is used herein in its generic sense and includes graphite fibers as well as amorphous carbon fibers. Graphite fibers are defined herein as fibers which consist essentially of carbon and have a predominant x-ray diffraction pattern characteristic of graphite. Amorphous carbon fibers, on the other hand, are defined as fibers in which the bulk of the fiber weight can be attributed to carbon and which exhibit an essentially amorphous x-ray diffraction pattern. Graphite fibers generally have a higher Young's modulus than do amorphous carbon fibers and in addition are more highly electrically and thermally conductive.

Industrial high performance materials of the future are projected to make substantial utilization of fiber reinforced composites, and carbon fibers theoretically have among the best properties of any fiber for use as high strength reinforcement. Among these desirable properties are corrosion and high temperature resistance, low density, high tensile strength, and high modulus. Graphite is one of the very few known materials whose tensile strength increases with temperature. Uses for carbon fiber reinforced composites include aerospace structural components, rocket motor casings deep-submergence vessels, and ablative materials for heat shields on re-entry vehicles.

In the prior art numerous materials have been proposed for use as possible matrices in which carbon fibers may be incorporated to provide reinforcement and produce a composite article. The matrix material which is utilized is commonly a thermosetting resinous material or metal.

While it has been possible in the past to provide carbon fibers of highly desirable strength and modulus characteristics, difficulties have arisen when one attempts to gain the full advantage of such properties in the resulting carbon fiber reinforced composite article. Such inability to capitalize upon the superior single filament properties of the reinforcing fiber has been traced to inadequate bonding between the fiber and the matrix in the resulting composite article.

Heretofore, composite articles produced by the incorporation of graphite fibers in a magnesium matrix have been projected to hold the potential of offering the highest specific strength of any metallic structural material. See, for instance "Metallic Matrix Composites" edited by Kenneth G. Kreider, Vol. 4, Page 381 (Academic Press. 1974). However, it has been found that substantial bonding difficulties between the carbon fiber reinforcement and the metallic matrix have been encountered when one has attempted to utilize a metal matrix material which is a magnesium containing metal. Carbon fibers normally are not wetted to any significant degree by molten magnesium or magnesium alloys. Poor adhesion between the fiber reinforcement and the matrix is the consequence.

Various techniques have been proposed in the past for modifying the fiber properties of a previously formed carbon fiber via an intermediate process in order to make possible improved adhesion when present in a composite article. For instance in the prior art techniques it has been proposed to overcome carbon fiber bonding difficulties by precoating the carbon fibers prior to introducing them into molten magnesium. According to such proposals the wettability of such fibers by molten magnesium previously has been enhanced by precoating with titanium via plasam spraying or physical or chemical vapor deposition, or by electroplated or electroless nickel. Such precoating techniques have proven to be highly time consuming and expensive. The difficulties encountered when coating carbon yarn or tow on a large scale, particularly when done continuously, are enormous. The available coating materials which will not react chemically with the carbon fiber are limited, e.g. titanium and boron. The equipment utilized for vapor precoating must be air and vacuum tight which is difficult to reliably accomplish in a continuous operation. The precoating thickness is difficult to control and generally is rather high, e.g. one micrometer or more in thickness. As a result if the coating forms a substantial portion of the metal matrix, this commonly is detrimental to composite properties. The formation of carbon fiber reinforced composites employing a magnesum containing metal matrix accordingly has been limited in the prior art in spite of the outstanding property potential offered by the resulting composite article if good adhesion between the fiber reinforcement and matrix can be achieved.

It is an object of the present invention to provide an improved process for the production of carbon fiber reinforced magnesium composite articles.

It is an object of the present invention to provide an improved process for the production of carbon fiber reinforced composite articles which renders the carbon fiber reinforcement readily wettable by a molten magnesium containing metal.

It is an object of the present invention to provide a process for the production of carbon fiber reinforced composite articles which overcomes bonding difficulties between carbon fiber reinforcement and a magnesium containing metal matrix encountered in the prior art.

It is an object of the present invention to provide an improved process for the production of carbon fiber reinforced magnesium composite articles which eliminates the need for an intermediate carbon fiber precoating step.

It is an object of the present invention to provide an improved process for the production of carbon fiber reinforced magnesium composite articles exhibiting highly satisfactory mechanical properties especially in the area of enhanced fiber strength translation in the composite which may be carried out on an expeditous and inexpensive basis.

It is an object of the present invention to provide a process for the production of a carbon fiber reinforced magnesium composite which exhibits an improved compressive and shear strength.

It is another object of the present invention to provide improved composite articles wherein carbon fiber reinforcement is incorporated in a magnesium containing matrix using a fiber-wetting magnesium compound as a promoter of adhesion between the carbon fiber reinforcement and the magnesium-base matrix.

These and other objects as well as the scope, nature, and utilization of my invention will be apparent to those skilled in the art from the following description and claims.

SUMMARY OF THE INVENTION

It has been found that in a process for the formation of a carbon fiber reinforced composite article wherein carbon fibers are incorporated in a magnesium containing metallic matrix comprising (a) providing the carbon fibers in contact with a molten magnesium containing metal while at a temperature above the melting point of the metal, and (b) cooling the resulting magnesium containing metal having the carbon fibers incorporated therein to a temperature below the melting point of the metal, improved results are achieved by providing in the molten magnesium containing metal when contacted with the carbon fibers prior to cooling a minor quantity of dispersed solid magnesium nitride sufficient to enhance the wettablity of the carbon fibers by the magnesium containing metal.

In accordance with the present invention improved carbon fiber reinforced magnesium composite articles are formed exhibiting good adhesion between the fiber reinforcement and metallic matrix.

DESCRIPTION OF PREFERRED EMBODIMENTS

The Carbon Fiber Reinforcement

The fibers which are utilized in the present process are carbonaceous and contain at least 90 percent carbon by weight. Such carbon fibers may exhibit either an amorphous carbon or a predominantly graphitic carbon x-ray diffraction pattern. In a preferred embodiment of the process the carbonaceous fibers contain at least about 95 percent carbon by weight, and at least about 99 percent carbon by weightin a particularly preferred embodiment of the process.

The carbonaceous fibrous material may be provided as either continuous or discontinuous lengths. The carbonaceous fibrous material may be provided in any one of a variety of physical configuration. For instance, the carbonaceous fibrous material may assume the configuration of a continuous length of a multifilament yarn, tow, tape, strand, cable, or similar fibrous assemblage. In a preferred embodiment of the process the carbonaceous fibrous material is one or more continuous multifilament yarns or tows.

The carbonaceous fibrous material which is utilized in the present process optionally may be provided with a twist which tends to improve the handling characteristics. For instance, a twist of about 0.1 to 5 tpi, and preferably about 0.3 to 1.0 tpi, may be imparted to a multifilament yarn. Also, a false twist may be used instead of or in addition to a real twist. Alternatively one may select continuous bundles of fibrous material which possess essentially no twist.

The carbonaceous fibers which are utilized in the present process may be formed in accordance with a variety of techniques as will be apparent to those skilled in the art. For instance, organic polymeric fibrous materials which are capable of undergoing thermal stabilization may be initially stabilized by treatment in an appropriate atmosphere at a moderate temperature (e.g., 200° to 400° C.) and subsequently heated in an inert atmosphere at a more highly elevated temperature e.g. 900° to 1,000° C. or more, until a carbonaceous fibrous material is formed. If the thermally stabilized material is heated to a maximum temperature of 2,000° to 3,100° C, (preferably 2,400° to 3,100° C.) in an inert atmosphere, substantial amounts of graphitic carbon are commonly detected in the resulting carbon fiber, otherwise the carbon fiber will commonly exhibit an essentially amorphous x-ray diffraction pattern.

The exact temperature and atmosphere utilized during the initial stabilization of an organic polymeric fibrous material commonly vary with the composition of the precursor as will be apparent to those skilled in the art. During the carbonization reaction elements present in the fibrous material other than carbon (e.g., oxygen and hydrogen) are substantially expelled. Suitable organic polymeric fibrous materials from which the fibrous material capable of undergoing carbonization may be derived include an acrylic polymer, a cellulosic polymer, a polyamide, a polybenzimidazole, polyvinyl alcohol, pinch, etc. As discussed hereafter, acrylic polymeric materials are particularly suited for use as precursors in the formation of carbonaceous fibrous materials. Illustrative examples of suitable cellulosic materials include the natural and regenerated forms of cellulose, e.g., rayon. Illustrative examples of suitable polyamide materials include the aromatic polyamides, such as nylon 6T, which is formed by the condensation of hexamethylenediamine and terephthalic acid. An illustrative example of a suitable polybenzimidazole is poly-2,2'-m-phenylene-5,5'-bibenzimidazole.

A fibrous acrylic polymeric material prior to stabilization may be formed primarily of recurring acrylonitrile units. For instance the acrylic polymer should contain not less than about 85 mol percent of recurring acrylonitrile units with not more than about 15 mole percent of a monovinyl compound which is copolymerizable with acrylonitrile such as styrene, methyl acrylate, methyl methacrylate vinyl acetate, vinyl chloride, vinylidene chloride, vinyl pyridine, and the like, or a plurality of such monovinyl compounds.

During the formation of a preferred carbonaceous fibrous material for use in the present process multifilament bundles of an acrylic fibrous material may be initially stabilized in an oxygen-containing atmosphere (i.e., preoxidized). More specifically, the acrylic fibrous material should be either an acrylonitrile homopolymer or an acrylonitrile copolymer which contains no more than about 5 mol percent of one or more monovinyl comonomers copolymerized with acrylonitrile. In a particularly preferred embodiment of the process the fibrous materials is derived from an acrylonitrile homopolymer. The stablized acrylic fibrous material which is preoxidized in an oxygen-containing atmosphere is black in appearance, commonly contains a bound oxygen content of at least about 7 percent by weight as determined by the Unterzaucher analysis, retains its original fibrous configuration essentially intact, and is non-burning when subjected to an ordinary match flame.

In preferred techniques for forming the carbon fiber reinforcement for the present process a stabilized acrylic fibrous material is carbonized and graphitized while passing through a temperature gradient present in a heating zone in accordance with the procedures described in commonly assigned U.S. Pat. Nos. 3,677,705 and 3,900,556; and U.S. Ser. No. 354,469, filed Apr. 25, 1973 (now U.S. Pat. No. 3,594,950). Each of these disclosures is herein incorporated by reference.

The Magnesium Matrix

The matrix which is utilized in the present process is a magnesium containing metal. The metal matrix may be either substantially pure magnesium or an alloy which includes magnesium as either the major or a minor component. Commonly the magnesium will be present in the matrix metal in a concentration of about 25 to 100 percent by weight, and preferably in a concentration of about 88 to 96 percent by weight. However it is possible to advantageously utilize a magnesium containing metal in the process which contains as little as about 10 percent magnesium by weight based upon the total weight of the matrix metal. The only requirement is that enough magnesium be present in the matrix metal to interact with or be combined with nitrogen when the magnesium nitride is formed in situ as discussed hereafter. Any metal which is capable of being alloyed with magnesium may optionally also be present with magnesium in the metallic matrix. Representative metals which commonly are alloyed with magnesium include: aluminum, zinc, manganese, chromium, titanium, cerium, beryllium, thorium, etc. If nickel, cobalt or iron are present in the magnesium alloy these tend to decrease the corrosion resistance, and accordingly are substantially absent is preferred alloys. In addition to substantially pure magnesium the following specific alloys are preferred for use as the matrix-forming metal in the present process: general-purpose casting alloys such as AZ92A, ZK51A, or 220, or extrusion and wrought alloys such as AZ31B, or HM21A. Numerous other magnesium-containing alloys may be selected as will be apparent to those skilled in the art depending upon which property (e.g. fracture toughness, ductility, hardness, etc.) is to be emphasized in the reinforced composite.

The Composite Formation

It surprisingly has been found that substantially improved results are achieved if a minor quantity of solid magnesium nitride (i.e., $Mg_3N_2$) is dispersed in the molten magnesium containing metal which is to serve as the matrix material prior to the cooling or solidification of the same while in association with the carbon fiber reinforcement. The magnesium nitride is substantially insoluble in the molten magnesium containing alloy and is present as dispersed finely divided particles in a quantity sufficient to enhance the wettability of the carbon fibers by the molten magnesium containing metal. For instance, the magnesium nitride may be dispersed in the molten magnesium containing metal when contacted with the carbon fibers in a concentration of about 0.2 to 25 percent by weight based upon the total weight of the magnesium containing metal, and preferably in a concentration of about 1 to 10 percent by weight. The particle size of the magnesium nitride should be as fine as possible in order to achieve the maximum amount of intimate contact with the carbon fiber during compositing (i.e. making of the composite). Typically, a fine $Mg_3N_2$ having a particle size of less than 2 micrometers ($\mu$m) is satisfactory for achieving such contact.

In a preferred embodiment of the process the molten magnesium containing metal which is to serve as the matrix material prior to cooling or solidification is exposed to gaseous nitrogen whereby solid dispersed magnesium nitride is formed therein in the desired minor quantity. The molten magnesium containing metal is preferably at a temperature below about 1200° C. e,g, at a temperature of about 700° to about 1200° C. and most preferably at a temperature of about 800° C. to 850° C. when exposed to gaseous nitrogen. Representative exposure times commonly range from about 3 to about 200 minutes (e.g., about 5 to about 120 minutes). The carbon fiber reinforcement may be in contact with the molten magnesium containing alloy at the time the magnesium nitride is formed or introduced thereafter. If the $Mg_3N_2$ is formed in situ by reaction of the magnesium metal with the nitrogen ambient, a deliberate control of the particle size is generally not possible, but is usually not necessary since such "in situ" formed $Mg_3N_2$ particles tend to be very fine.

In a further embodiment a preformed magnesium nitride powder may be padded onto the carbon fiber from a conventional sizing bath filled with a dispersion of the $Mg_3N_2$ in a suitable non-aqueous liquid (e.g., isopropanol or methyl cellosolve) in the presence of a suitable surfactant to keep the dispersion from premature flocculation.

In an additional embodiment of the process the magnesium nitride may be preformed in another zone and the resulting solid dispersed in the molten magnesium containing metal in the desired minor concentration prior to cooling and its solidification in association with the carbon fiber reinforcement. Such magnesium nitride may be formed in accordance with any procedure known in the art and subsequently is dispersed in the molten metal while in a finely divided form. Representative synthesis routes for preforming the magnesium nitride include reacting the magnesium metal or its alloy directly with nitrogen at approximately 700° to 900° C. or reacting it with ammonia in the same temperature region. Alternatively, the magnesium nitride may be added to the magnesium or its alloy prior to its melting, and be dispersed in the matrix-forming material once the latter has been melted by rotating the container or by means of a refractory stirrer if needed.

In yet another embodiment the magnesium nitride powder can be generated in situ by adding a metallic nitride capable of reacting with magnesium to form $Mg_3N_2$ by displacing the original metal which after release would alloy with the residual magnesium of the matrix. Examples of such nitrides which upon release do not attack the carbon fiber are silicon nitride ($SiN_4$), aluminum nitride (AIN), titanium nitride (TiN), etc.

The carbon fiber reinforcement is contacted with the molten magnesium containing metal having dispersed therein solid magnesium nitride with the carbon fibers becoming infiltrated by the molten metal, and when present in the desired configuration the molten metal in association with the carbon fibers is cooled until it solidifies. The carbon fibers may be present in the magnesium containing metal at the time of the solidification in any one of a variety of configurations, such as those commonly used in the production of fiber reinforced composites in the prior art. For instance, the carbon fibers may be aligned as a uniform multifilament tow which is parallel to the axis of an elongated composite article which is to serve as a structural component. If desired, one may infiltrate a randomly oriented carbon fiber mat or a bidirectionally woven carbon fabric with the molten magnesium containing metal in order to produce a composite plate which may then be hot rolled into a fiber reinforced metal sheet. A similar unidirectionally or bidirectionally reinforced tape may be produced by hot rolling a liquid-infiltrated carbon fiber-magnesium composite rod. Commonly the carbon fibers are provided in the magnesium containing matrix in a quantity of approximately 5 to 60 parts by volume (e.g. 20 to 40 parts by volume) based upon the total volume of the resulting composite article.

After composite formation, the residual $MgN_2$ remains in the solidified matrix and is immobilized. Its refractory properties do not significantly modify the ultimate properties of the composite. Oxygen and water should generally be absent from the atmosphere during the fabrication of the composite articles, since they tend to interact to form magnesium oxide which does not wet the carbon fiber. However, trace amounts less than about 0.1 percent will provide so little magnesium oxide that the wettability is not adversely influenced to any appreciable degree.

The theory whereby the presence of magnesium nitride in the molten magnesium containing metal serves to significantly enhance the wettability of carbon fibers by the metal is considered complex and incapable of simple explanation. It is observed, however, that upon contact with the molten metal containing a minor quantity of solid dispersed magnesium nitride the carbon fibers are readily infiltrated by the metal, and that upon solidification of the molten metal good adhesion is observed between the carbon fibers and the magnesium containing matrix metal. It appears that the magnesium nitride present in the molten magnesium containing metal when contacted with the carbon fibers beneficially interacts with the surface of such fibers to form magnesium carbonitride (e.g. MgCxNy) which promotes wettability. Alternatively, it is possible that the magnesium nitride reacts with the surface of the carbon fibers to form magnesium cyanamide (e.g. $MgCN_2$). Since such reactions would take place only upon intimate contact with the carbon fiber, good adhesion is a necessary correlation. As the surface energy of the carbon fibers is lowered by the reaction, wetting and infiltration by the molten metal is made possible.

The resulting carbon fiber reinforced magnesium composite articles exhibit a uniform and complete infiltration of the fiber by the metal thereby providing a low void content composite, and a high specific strength (strength/density) the magnitude of which depends primarily upon the strength of the reinforcing fiber used. For instance, for a unidirectionally carbon fiber having an average tensile strength of 300,000 psi, the expected specific strength of the composite will be about $1.8 \times 10^6$ inches which is as high or higher than that of most fiber reinforced metal matrix composites. The presence of the carbon fiber reinforcement in intimate association with the metal matrix which is bonded to the same serves to minimize yielding and creeping of the composite article when utilized at highly elevated temperatures approaching the melting point of the metal. Furthermore, an improved fiber-metal adhesion greatly enhances the compressive and the shear strengths of the composite, both of which are important for structural applications. Likewise, the fatigue resistance the the impact resistance of well-bonded composites are clearly better than those of poorly bonded composites which often debond progressively under dynamic loading thereby precipitating a premature failure.

The composite articles of the present invention may be used in a variety of applications as will be apparent to those skilled in the art. Such composite articles are particularly suited for use in applications where a high specific strength is required. End use applications include structural components and high temperature resistant parts which must withstand high forces. Representative specific applications for such composite articles include: turbine fan blades, heat resistant pressure vessels, armor plates, etc. the solidified reinforced composites may be tempered, forged, wrought, and machined in the usual manner. In fact, the machining is often easier because of the natural lubricity of the reinforcing carbon (e.g. graphitic carbon) fibers.

The following examples are given as specific illustrations of the invention. It should be understood, however, that the invention is not limited to the specific details set forth in the examples.

EXAMPLE I

The magnesium metal selected is substantially pure magnesium having a melting point of about 651° C. available from Fisher Scientic Company as cast rod stocks of 0.5 inch diameter.

The carbon fibers selected exhibit a predominant graphitic x-ray diffraction pattern and contain in excess of 99 percent carbon by weight and are available from the Celanese Corporation under the designation of GY-70 graphite fiber. The as received carbon fibers have a denier per filament of about 0.9, and exhibit an average single filament tenacity of about 250,000 psi, and an average Young's modulus of about 77,000,000 psi.

The magnesium cast rod stock initially is pretreated in dilute hydrochloric acid, washed in deionized water, and rinsed in acetone to remove any extraneous material from the surface thereof.

The magnesium rods are melted in a graphite crucible present in an atmosphere of gaseous nitrogen by gradually heating to 840° C. over a period of 90 minutes, and held at 840° C. for 40 minutes. A minor quantity of solid magnesium nitride forms upon the reaction of the gaseous nitrogen with the molten magnesium which becomes dispersed in the molten metal as a finely divided solid. The quantity of solid magnesium nitride present in the molten magnesium is about 5 percent by weight based upon the weight of the metal.

While maintaining the resulting molten metal at a temperature of about 840° C. under an atmosphere of gaseous nitrogen a bundle of the carbon fibers while in a substantially parallel configuration is contacted with the molten metal and is immersed therein. The carbon fibers are immediately infiltrated and wetted by the molten magnesium and are maintained in the melt for about 15 minutes. The molten metal having the carbon fibers present therein next is cooled to room temperature over a period of about 45 minutes. As the molten metal solidifies a carbon fiber reinforced magnesium composite article forms which exhibits good adhesion between the fibers and the matrix metal with the carbon fibers being present within the composite in a concentration of about 25 percent by volume of the composite article. The ends of carbon fibers protruding from the composite article following solidification may be grasped by hand but may not be pulled out of the metal matrix. When pulled too hard, the fiber bundle will rather break off outside the matrix.

For comparative purposes Example I is repeated with the exception that argon gas is substituted for the nitrogen gas. No magnesium nitride is present in the molten magnesium when contacted with the carbon fibers. The carbon fibers are not wetted or infiltrated by the molten magnesium to any significant degree, and there is substantially no adhesion between the carbon fibers and the magnesium following solidification. The ends of carbon fibers protruding from the solidified magnesium may be grasped by hand and readily pulled out of the magnesium.

For comparative purposes Example I is repeated with the exception that argon gas is substituted for 50 percent by volume of the nitrogen gas. The molten magnesium is exposed to 50 percent by volume gaseous argon and 50 percent by volume gaseous nitrogen. The results achieved are substantially similar to those of Example I.

EXAMPLE II

The magnesium metal and carbon fibers are as described in Example I.

However, the magnesium nitride is preformed in a different synthesis by melting a small disc cut from the magnesium rod stock in a graphite crucible and holding the melt at 850° C. in a nitrogen atmosphere for one hour during which time a light grey solid layer of $Mg_3N_2$ formed upon the surface of the magnesium. This layer was scraped off the unreacted magnesium after its solidification, and the resulting solid fine magnesium nitride powder was placed in another crucible together with some other magnesium rod stock to serve as the future matrix. The concentration of the magnesium nitride was about 10 percent by weight based upon the weight of the magnesium, and the metal together with the magnesium nitride gradually heated to 840° C. over a period of 90 minutes while under gaseous argon. The solid magnesium nitride becomes intermixed with the molten magnesium.

While maintaning the resulting molten metal at a temperature of about 840° C. under an atmosphere of gaseous argon a bundle of the carbon fibers is contacted with the same as described in Example I.

Substantially similar results are achieved as in Example I. In the presence of $Mg_3N_2$ the carbon fiber bundle is readily wetted, penetrated and thoroughly infiltrated by the liquid magnesium matrix. Microscopic examination of a cut cross-section of the resulting infiltrated bundle shows that the composite is virtually free of voids, cracks, or other structural defects.

Although the invention has been described with preferred embodiments, it is to be understood that variations and modifications may be resorted to as will be apparent to those skilled in the art. Such variations and modifications are to be considered within the purview and scope of the claims appended hereto.

I claim:

1. In a process for the formation of a carbon fiber reinforced composite article wherein carbon fibers are incorporated in a magnesium containing metallic matrix comprising (a) providing said carbon fibers in contact with a molten magnesium containing metal while at a temperature above the melting point of said metal, and (b) cooling the resulting magnesium containing metal having said carbon fibers incorporated therein to a temperature below the melting point of said metal; the improvement comprising providing in said molten magnesium containing metal when contacted with said carbon fibers prior to said cooling a minor quantity of dispersed solid magnesium nitride sufficient to enhance the wettability of said carbon fibers by said magnesium containing metal.

2. An improved process according to claim 1 wherein said magnesium containing metal comprises about 25 to 100 percent by weight magnesium.

3. An improved process according to claim 1 wherein said magnesium containing metal is substantially all magnesium.

4. An improved process according to claim 1 wherein said solid magnesium nitride is dispersed in said molten magnesium containing metal when contacted with said carbon fibers in a concentration of about 0.2 to 25 percent by weight based upon the weight of said magnesium containing metal.

5. In a process for the formation of a carbon fiber reinforced composite article wherein carbon fibers are incorporated in a magnesium containing metallic matrix comprising (a) providing said carbon fibers in contact with a molten magnesium containing metal while at a temperature above the melting point of said metal, and (b) cooling the resulting magnesium containing metal having said carbon fibers incorporated therein to a temperature below the melting point of said metal; the improvement comprising exposing said molten magnesium containing metal prior to said cooling to gaseous nitrogen whereby solid dispersed magnesium nitride is formed therein in a minor quantity sufficient to enhance the wettability of said carbon fibers by said magnesium containing metal.

6. An improved process according to claim 5 wherein said magnesium containing metal comprises about 25 to 100 percent by weight magnesium.

7. An improved process according to claim 5 wherein said magnesium containing metal is substantially all magnesium.

8. An improved process according to claim 5 wherein said molten magnesium containing metal at a temperature below about 1200° C. is exposed to said gaseous nitrogen.

9. An improved process according to claim 8 wherein said molten magnesium containing metal is exposed to gaseous nitrogen for about 3 to about 200 minutes.

10. An improved process according to claim 6 wherein said molten magnesium containing metal while at a temperature of about 800° to 1000° C. is exposed to said gaseous nitrogen.

11. An improved process according to claim 7 wherein said molten magnesium containing metal while at a temperature of about 800° to 850° C. is exposed to said gaseous nitrogen for about 5 to 120 minutes.

12. An improved composite article wherein carbon fiber reinforcement is incorporated in a magnesium containing metal matrix formed in accordance with the process of claim 1.

* * * * *